US005173585A

United States Patent [19]

Dokken

[11] Patent Number: 5,173,585

[45] Date of Patent: Dec. 22, 1992

[54] CAMERA HEATING JACKET

[76] Inventor: Brian L. Dokken, P.O. Box 244, Velva, N. Dak. 58790

[21] Appl. No.: 696,367

[22] Filed: May 6, 1991

[51] Int. Cl.[5] ..... A45C 11/38; B65D 85/38; H05B 3/34

[52] U.S. Cl. ..... 219/201; 206/316.2; 219/209; 219/521; 219/528; 219/535; 354/76

[58] Field of Search ..... 219/201, 200, 535, 528, 219/549, 211, 209, 521; 358/229; 354/81, 76; 206/316.2

[56] References Cited

U.S. PATENT DOCUMENTS

| | | | |
|---|---|---|---|
| 2,277,772 | 3/1942 | Marick | 219/211 |
| 2,342,513 | 2/1944 | Gaty | 219/201 X |
| 2,345,365 | 3/1944 | Steiner | 219/201 X |
| 2,353,898 | 7/1944 | Nitsch | 219/201 X |
| 2,404,736 | 7/1946 | Marick | 219/535 |
| 2,442,913 | 6/1948 | Abrams et al. | 219/521 X |
| 2,617,012 | 11/1952 | Westley . | |
| 3,079,486 | 5/1961 | Winchell . | |
| 3,968,348 | 7/1976 | Stanfield | 219/535 |
| 4,320,949 | 3/1982 | Pagano | 354/81 |
| 4,355,861 | 10/1982 | Sebald | 219/201 X |
| 4,485,407 | 11/1984 | Bohm et al. | 358/229 |
| 4,558,206 | 12/1985 | Ball | 219/528 X |
| 4,736,218 | 4/1988 | Kutman | 354/81 |
| 4,762,978 | 8/1988 | Tanis | 219/209 |
| 4,927,017 | 5/1990 | Easter | 206/316.2 |
| 4,984,089 | 1/1991 | Stiepel et al. | 354/81 X |

FOREIGN PATENT DOCUMENTS

| | | | |
|---|---|---|---|
| 2061691 | 6/1972 | Fed. Rep. of Germany | 206/316.2 |

*Primary Examiner*—Anthony Bartis
*Attorney, Agent, or Firm*—Zarley, McKee, Thomte, Voorhees & Sease

[57] ABSTRACT

An electrically heated jacket for use on a video camera or the like which enables the camera to be used in cold temperatures. The jacket comprises a flexible member having heating elements embedded therein and which may be positioned around the camera and secured thereto by suitable connectors. The jacket conforms to the shape of the camera and has selectively closeable openings to provide access to various camera controls. The jacket is formed from a flat sheet of insulative material with a forward flap operable to selectively cover the lens on the camera. Flaps along opposing side edges of the sheet will wrap over the top of the camera to permit a handle on the camera to project from the jacket.

1 Claim, 3 Drawing Sheets

CAMERA HEATING JACKET

BACKGROUND OF THE INVENTION

The outdoor use of video cameras in cold temperatures presents a problem in that the mechanical and electro-mechanical components of the video camera tend to become "sluggish" or will not function at all. Further, the exposure of the camera to the cold temperatures effects the efficiency or cranking power of the camera battery.

It is therefore one of the primary objects of the invention to provide a means for permitting the use of a video camera in cold temperatures.

A further object of the invention is to provide an electrically heated jacket or glove which may be wrapped around a video camera.

Still another object of the invention is to provide an electrically heated jacket adapted to be wrapped around a video camera and which has openings and selectively closeable openings formed therein to provide access to the various camera controls.

Still another object of the invention is to provide an electrically heated jacket which may be quickly and easily positioned on a video camera and quickly and easily removed therefrom.

Still another object of the invention is to provide an electrically heated jacket for a video camera which is economical to manufacture, durable in use and refined in appearance.

These and other objects will be apparent to those skilled in the art.

SUMMARY OF THE INVENTION

Figure 1:
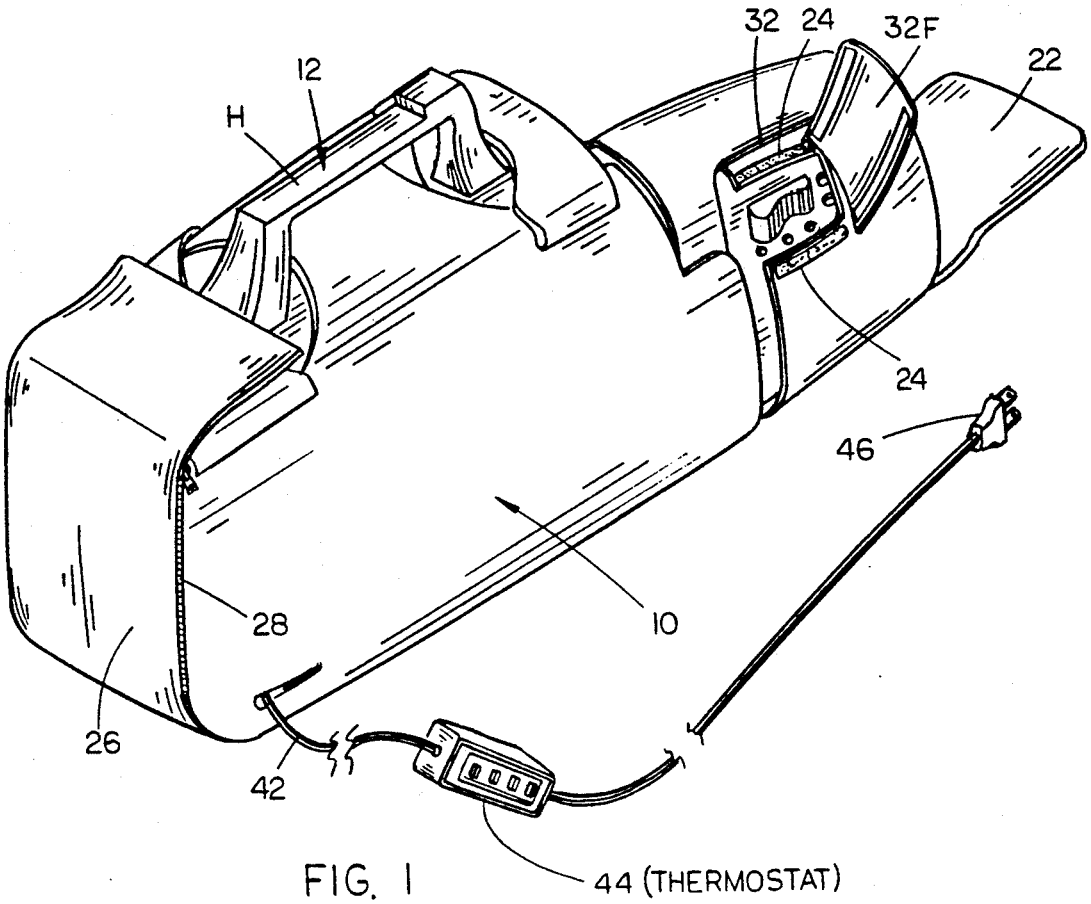
FIG. 1 is a perspective view of the electrically heated jacket of this invention mounted on a video camera.
Figure 2:
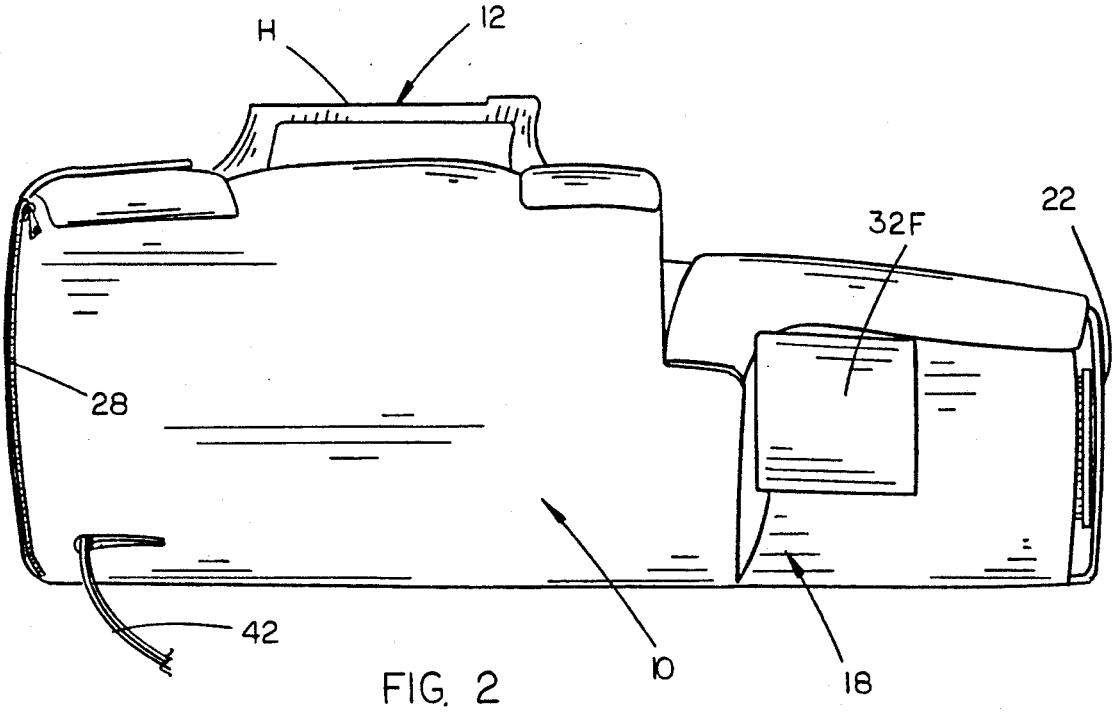
FIG. 2 is a side view of the jacket and camera.
Figure 3:
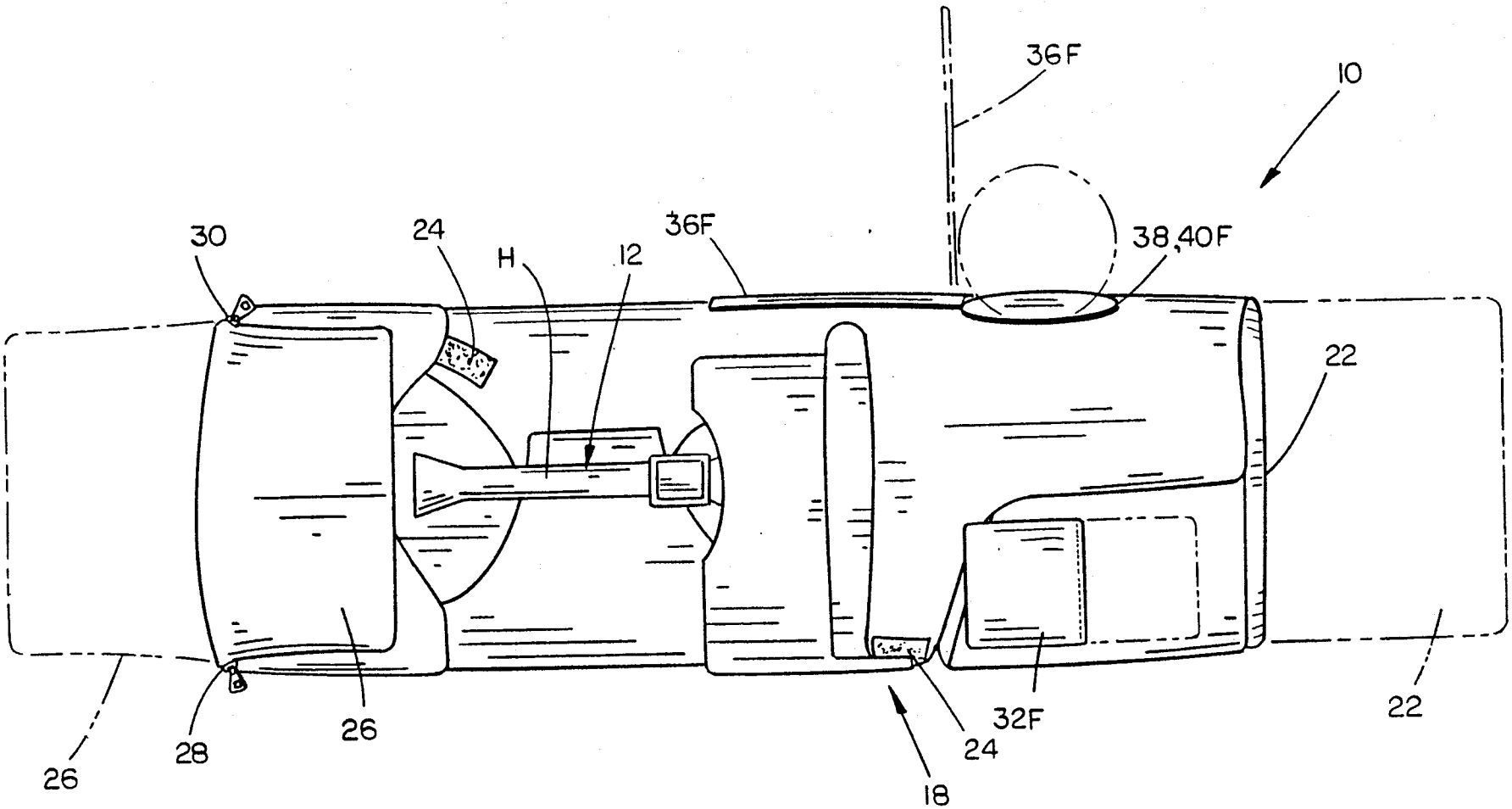
FIG. 3 is a top view of the jacket mounted on the camera.

An electrically heated jacket is described for use on a video camera which enables the camera to be used in cold temperatures. The jacket consists of a flexible member having heating elements embedded therein and which may be positioned around the video camera and secured thereto by Velcro connectors or the like. The jacket is shaped so as to conform to the camera and has selectively closeable openings to provide access to various camera controls. The electrical heating element may be either connected to a 110 volt source of electrical power or to a 12 volt DC source of power. Further, the heating element could be connected to rechargeable batteries or to the camera battery.

DESCRIPTION OF THE PREFERRED EMBODIMENT

The numeral 10 refers generally to the electrically heated jacket of this invention while the numeral 12 refers to a conventional video camera. Inasmuch as video cameras manufactured by various companies have different configurations and dimensions, the jacket 10 of this invention takes many forms. Thus, the video jacket described herein will fit the particular video camera 12 illustrated herein. Regardless of the particular shape of the jacket 10, it is preferred that the jacket

10 be of a flexible waterproof material and that the same include an insulation layer therein. Further, the jacket 10 could be comprised of a product such as Thinusulate. Regardless of the particular shape that the jacket 10 may take, it is critical that the jacket 10 have suitable openings formed therein, and preferably selectively closeable openings, to provide convenient access to the various camera controls.

Figure 4:
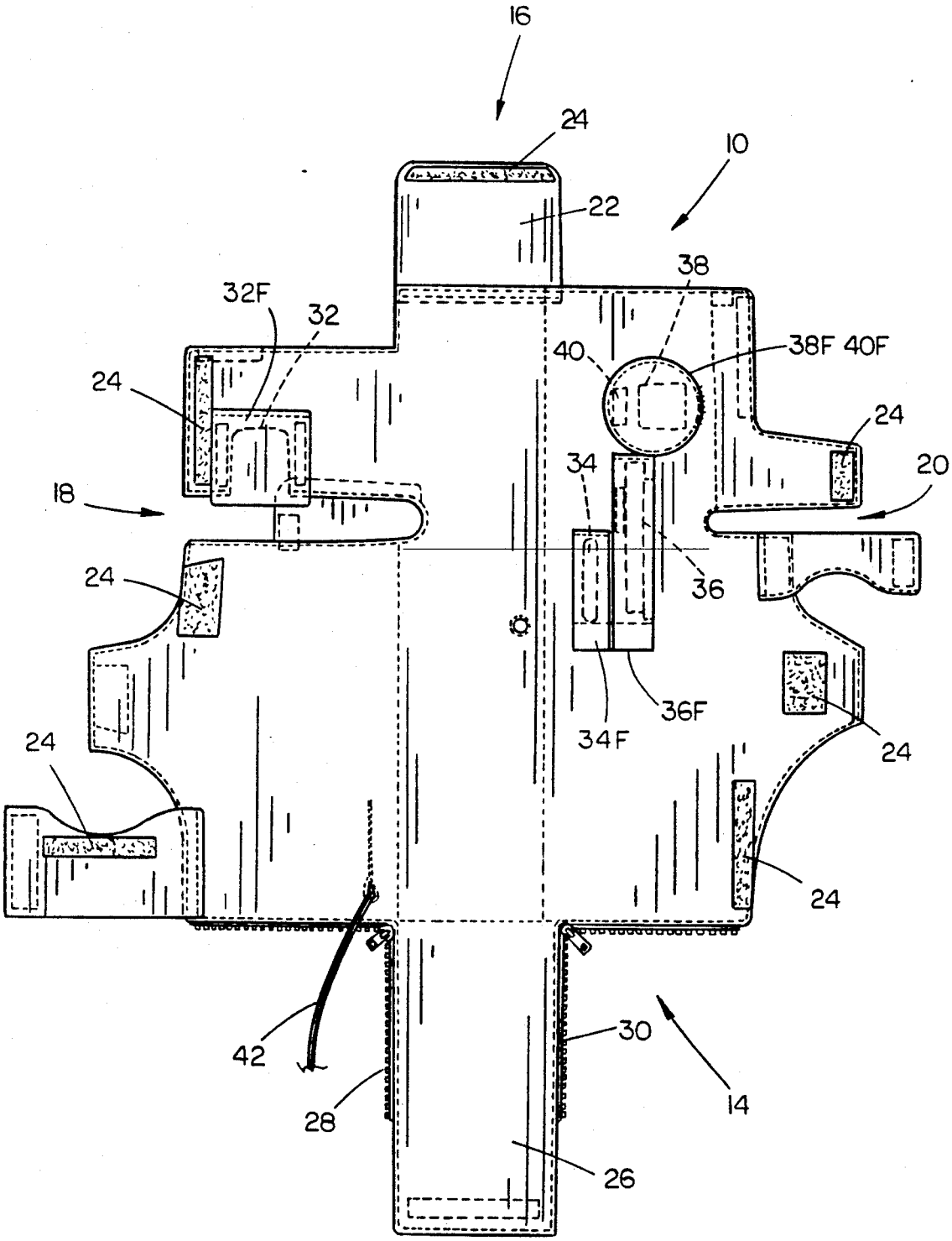
FIG. 4 is an elevational view of the jacket of this invention in its flat condition.

For purposes of description, jacket 10 will be described as including a rearward end 14, forward end 16, and opposite sides 18 and 20. The forward end 16 of jacket 10 includes a flap 22 having a Velcro fastener 24 provided on its inner surface which is adapted to be positioned over the lens of the camera at times and which is able to be opened at times to permit the camera to be used. As seen in FIG. 4, the rearward end 14 of the jacket 10 is provided with a flap 26 having zippers 28 and 30 applied thereon to enable the flap to be positioned as illustrated in FIG. 1 to enclose the rearward end of the camera.

Jacket 10 is provided with a plurality of selectively closeable openings 32, 34, 36, 38 and 40 to permit ready access or convenient access to the various controls on the camera. The openings 32, 34, 36, 38 and 40 are selectively closed by flexible flaps including Velcro connectors thereon as illustrated in the drawings. The various flaps will be identified by the reference letters 32F, 34F, 36F, 38F, and 40F. Jacket 10 is also designed so as to permit the handle H to extend outwardly therethrough as seen in FIG. 1. Electrical lead 42 extends into the jacket 10 and is connected to a conventional heating element (not shown) embedded in the jacket 10. Thermostat 44 is provided in lead 42 so as to control the temperature of the heating element. Plug 46 is provided on lead 42 to enable the heating element to be connected to a source of 110 volt AC current. If the camera is to be used outdoors near a source of 110 volt current, plug 46 is simply connected to an extension cord or like with the extension cord being plugged into the source of 110 volt power. If the camera is to be used at a remote location where 110 volt power is not available, the apparatus can be connected to a suitable adapter to enable the heating element to be operated by 12 volt DC power supply. Further, the heating element could be powered by rechargeable batteries or could be connected to the camera battery.

The jacket 10 may be easily and quickly mounted on the camera 12 by simply positioning the jacket 10 on the camera as illustrated in the drawings and securing the various Velcro fasteners and straps. The various flaps 32F, 34F, 36F, 38F and 40F protect the various controls and serve to retain heat within the jacket 10 during periods of nonuse. When it is desired to use the camera outdoors, the jacket 10 may be pre-heated by means of the 110 volt current or the 12 volt current as previously described. The camera may be then disconnected, if desired, from its source of electrical power, and then taken outdoors. The insulated jacket 10 will retain heat within the jacket and will prevent the camera from becoming cold and "sluggish". If the camera is to be used outdoors for a considerable length of time, the electrical heating element would remain connected to a source of 12 volt power.

Thus it can be seen that a novel electrically heated jacket has been provided for a video camera which enables the video camera to be used outdoors in cold weather. Although the jacket is designed primarily for use with a video camera, the jacket could also be used with a conventional 35 mm camera or the like if so desired.

I claim:

1. In combination:

a camera having forward and rearward ends, opposing sides, a bottom and a top;

a lens mounted on the forward end of said camera;

a flat flexible sheet of insulative material having a forward end, rearward end and opposing sides;

said sheet wrapped around said camera to form an insulative jacket enclosing said camera;

said sheet having a forward flap for selectively covering said lens;

means for selectively connecting said forward flap to portions of said jacket to selectively cover said lens;

said jacket having access openings formed therein providing access to controls on said camera;

flaps of insulative material selectively operably connected to said jacket to selectively cover said access openings;

means on said jacket for selectively maintaining said jacket on said camera;

an electrical heating element mounted in said jacket;

means for activating said heating element to heat the camera within the jacket;

said camera having a handle extending from the top of said camera;

said handle having a grip portion positioned above and in spaced relation to the top of said camera; and said jacket having flaps along its opposing sides wrapped over the camera top forwardly and rearwardly of said handle and beneath said grip portion of the handle such that the camera top is substantially completely covered and such that the handle projects outwardly above the jacket to permit the camera to be carried by the handle.

* * * * *